US006866548B2

(12) United States Patent
Hashim

(10) Patent No.: US 6,866,548 B2
(45) Date of Patent: Mar. 15, 2005

(54) CORRECTING FOR NEAR-END CROSSTALK UNBALANCE CAUSED BY DEPLOYMENT OF CROSSTALK COMPENSATION ON OTHER PAIRS

(75) Inventor: Amid I. Hashim, Plano, TX (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 10/278,323

(22) Filed: Oct. 23, 2002

(65) Prior Publication Data

US 2004/0082227 A1 Apr. 29, 2004

(51) Int. Cl.[7] ..... H01R 24/00; H01R 9/22
(52) U.S. Cl. ..... 439/676; 439/941
(58) Field of Search ..... 439/676, 941, 439/620

(56) References Cited

U.S. PATENT DOCUMENTS 5,326,284 A * 7/1994 Bohbot et al. ..... 439/676
5,547,405 A * 8/1996 Pinney et al. ..... 439/894
5,967,853 A * 10/1999 Hashim ..... 439/676
5,997,358 A 12/1999 Adriaenssens et al. ..... 439/676
6,023,200 A * 2/2000 Rhee ..... 331/1
6,089,923 A * 7/2000 Phommachanh ..... 439/676
6,270,381 B1 8/2001 Adriaenssens et al. ..... 439/676
6,379,157 B1 * 4/2002 Curry et al. ..... 439/676
6,383,029 B1 * 5/2002 Bolouri-Saransar ..... 439/676
6,428,362 B1 * 8/2002 Phommachanh ..... 439/676
6,520,808 B2 * 2/2003 Forbes et al. ..... 439/676
6,533,618 B1 * 3/2003 Aekins ..... 439/676

* cited by examiner

*Primary Examiner*—Chandrika Prasad
(74) *Attorney, Agent, or Firm*—Thomas, Kayden, Horstemeyer & Risley, LLP

(57) ABSTRACT

The present invention is directed to a system and method for reducing crosstalk caused by compensation schemes used in a connector to reduce crosstalk. The system provides for balancing crosstalk in an electrical connector having three or more pairs of conductors, wherein two pairs of conductors form a pair combination. The connector also has at least one compensating coupling device connected between conductor pairs of a first pair combination. The compensating coupling device disturbs the crosstalk balance of a second pair combination. The system for balancing crosstalk in the second pair combination includes a corrective coupling device that is connected between the conductor pairs of the second pair combination. In addition, compensating coupling devices in the second pair combination can be adjusted to counteract any crosstalk disturbances caused by the corrective coupling device.

34 Claims, 5 Drawing Sheets

CORRECTING FOR NEAR-END CROSSTALK UNBALANCE CAUSED BY DEPLOYMENT OF CROSSTALK COMPENSATION ON OTHER PAIRS

BACKGROUND OF THE INVENTION

1. Field of the Invention

The present invention generally relates to electrical connectors, and more particularly, to connectors designed to compensate for crosstalk induced on a conductor pair from other conductor pairs.

2. Related Art

In conventional electrical communication systems, such as these for telephony and data applications, a balanced signal is transmitted over a communication path composed of a pair of conductors that are not grounded. The balanced, or differential, signal constitutes the voltage difference between the individual conductors in the pair without regard to the absolute voltages present on each conductor. In such conductor pair transmission systems, an electromagnetic field is often created that interferes with signals on adjacent conductors. As the frequency of the transmitted signal increases, the effects of this interference become even greater. This interference is electrical noise and is commonly referred to as crosstalk.

Crosstalk can occur at any place where conductor pairs are in close proximity. A particular type of crosstalk called near-end crosstalk (NEXT) occurs at the near ends of communication or transmission paths, since the near end of a path may have eight or more wires situated close together over a very short distance.

NEXT is the portion of a transmitted signal that is electromagnetically coupled back into the received signal. For example, NEXT occurs in telephone communication whenever a separate communication is overheard on a telephone. In the case of computer networks, NEXT occurs when a strong signal on one pair of wires is picked up by an adjacent pair of wires. Two different types of NEXT can be induced in an adjacent pair of conductors, namely, differential-mode crosstalk and common-mode crosstalk.

Differential-mode crosstalk corresponds to a differential or balanced signal that is induced in the adjacent pair, where the currents in the two wires of that pair flow in opposite directions. Common-mode crosstalk corresponds to a common-mode or an unbalanced signal that is induced in the adjacent pair, where the currents in the two wires of that pair flow in the same direction. When a differential-mode signal exists on one pair, it may induce both differential-mode and common-mode crosstalk on an adjacent wire pair. The actual magnitude for each crosstalk mode is influenced by a number of factors, such as the relative proximities of the individual wires of the pair carrying the signal to the individual wires of the adjacent pair experiencing the crosstalk.

In attempts to reduce or compensate for NEXT crosstalk in communication paths, compensating signals are often introduced to counteract the effects of the crosstalk disturbances or noise. Such crosstalk compensation is achieved by connecting coupling devices, such as capacitors or capacitance-producing patterns on printed wiring boards, between different pairs of conductors of a multi-pair connector. Customarily, multiple compensation stages are needed because, at high frequencies, crosstalk compensating signals cannot be introduced that are exactly 180 degrees out of phase with the offending crosstalk through utilization of a single compensation stage.

For example, U.S. Pat. No. 5,997,358, issued on Dec. 7, 1999, discloses a multi-stage compensation scheme. In accordance with this scheme, crosstalk compensation is introduced either by creating crossovers of certain conductors within the connector, or by appropriately placing capacitors to compensate for differential-mode crosstalk. U.S. Pat. No. 5,967,853, issued on Oct. 19, 1999, describes a multi-stage compensation scheme that uses capacitors between different pairs of conductors to compensate for both common-mode and differential-mode crosstalk. In U.S. Pat. No. 6,270,381, issued on Aug. 7, 2001, a multi-stage compensation scheme is disclosed that uses crossovers between different pairs of conductors to compensate for common-mode and differential-mode crosstalk.

Existing crosstalk compensation schemes used with electrical connectors, such as those described above, are designed to compensate for crosstalk induced in a pair of conductors from an adjacent driven pair of conductors. Such existing crosstalk compensation schemes, however, may actually disturb the crosstalk balance of nearby pairs. A heretofore unaddressed need exists in the industry for a system and method that corrects NEXT crosstalk unbalance introduced by crosstalk compensation schemes.

Accordingly, a need exists to compensate for NEXT unbalance in a pair combination caused by a NEXT compensation scheme deployed on another pair combination. A further need exists for such a compensation technique that could be employed with connectors that are designed to meet the proposed Category 6 cabling standard set forth by the Telecommunication Industry Association (TIA) task group under TIA/EIA-568-B.2-1 (addendum No. 1 to TIA/EIA-568-B.2).

SUMMARY OF THE INVENTION

The present invention overcomes the inadequacies and deficiencies of the prior art as discussed hereinbefore. Generally, the present invention is directed to a system and method for correcting NEXT unbalance in a pair combination generated from a crosstalk compensation scheme on another pair combination in a connector.

In accordance with one aspect of the present invention, a system for balancing crosstalk in an electrical connector with the following features is provided. The electrical connector has three or more pairs of conductors, wherein two pairs of conductors form a pair combination. The connector also has at least one compensating coupling device connected between the two pairs of conductors in a first pair combination. The compensating coupling device disturbs the crosstalk balance of a second pair combination. Thus, one embodiment of the present invention provides a system to compensate for the crosstalk disturbance in the connector caused by the compensating coupling device. The system includes at least one corrective coupling device connected between the two pairs of conductors in the second pair combination. In addition, one or more compensating coupling devices connected between the two pairs of conductors in the second pair combination are to counteract any crosstalk disturbances caused by one or more of the corrective coupling device.

In accordance with another aspect of the present invention, a method for balancing crosstalk in an electrical connector with the following features is provided. The electrical connector has three or more pairs of conductors, wherein two pairs of conductors form a pair combination. The connector also has at least one compensating coupling device connected between the two pairs of conductors in a first pair combination. The compensating coupling device disturbs the crosstalk balance of a second pair combination. In this regard, an embodiment of the method can be summarized by the following steps: Adding at least one corrective coupling device between the two pairs of conductors in second pair combination, wherein the corrective coupling device compensates for crosstalk balance disturbances generated by the compensating coupling device in the first pair combination; and adjusting compensating coupling devices in the second pair combination to counteract any crosstalk disturbances caused by the corrective coupling device.

Other features and advantages of the present invention will become apparent to one with skill in the art upon examination of the following drawings and detailed description.

BRIEF DESCRIPTION OF THE DRAWINGS

The invention can be better understood with reference to the following drawings. The elements of the drawings are not necessarily to scale relative to each other, emphasis instead being placed upon clearly illustrating the principles of the invention. Furthermore, like reference numerals designate corresponding parts throughout the several views.

DETAILED DESCRIPTION OF THE PREFERRED EMBODIMENT

Figure 1:
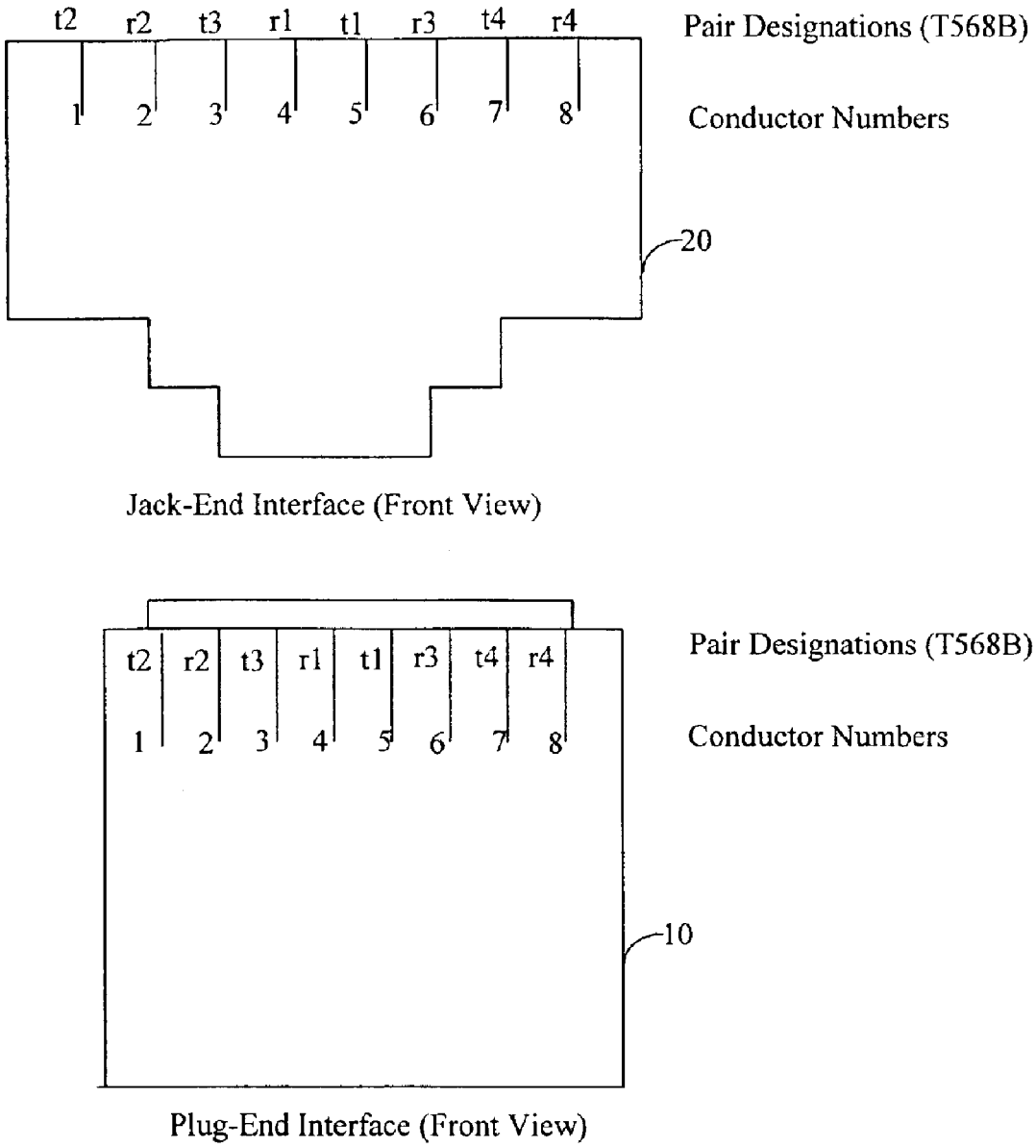
FIG. 1 (Prior Art)
FIG. 1 is a schematic drawing representing a known wiring scheme for a modular plug and jack under the TIA T568B specification.

The present invention provides a system and method for compensating for crosstalk balance in a pair combination whose crosstalk balance has been compromised by the deployment of compensation schemes on other pair combinations. FIG. 1 is a schematic drawing representing the wiring scheme for a known modular plug 10 and jack 20 under the TIA T568B specification. Consider, for example, pairs 1 (conductors 4 and 5) and 3 (conductors 3 and 6) in FIG. 1. Although the pair combination is originally balanced, the asymmetric placement of capacitive couplings (not shown) around pairs 1 and 3 at various stages in a multistage compensation scheme for pairs 1&2 and 2&3 on one side and for pairs 1&4 and 3&4 on the other side could cause the crosstalk balance of the pair combination (pairs 1 and 3) to become compromised.

Figure 2:
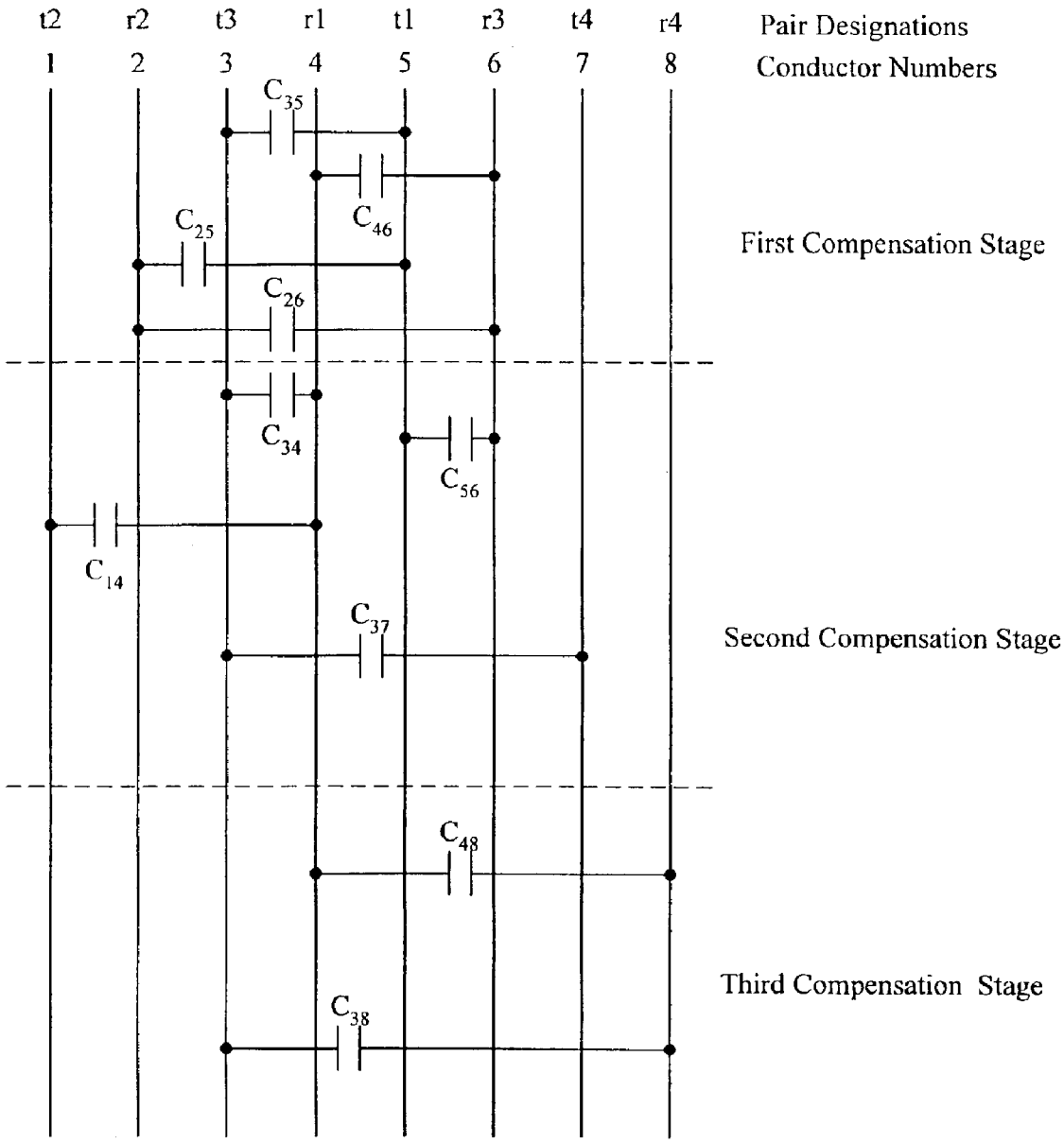
FIG. 2 (Prior Art)
FIG. 2 is a schematic drawing representing a known differential-mode to differential-mode crosstalk compensation scheme for a modular plug/jack combination of FIG. 1.

Now consider FIG. 2, which is a schematic drawing representing a known differential-mode to differential-mode crosstalk compensation scheme for a modular plug/jack combination such as that of FIG. 1. The differential-mode to differential-mode crosstalk compensation scheme of FIG. 2 is a multistage capacitive compensation scheme implemented on a printed wiring board (PWB) that works in complement with a typically inductive lead frame first stage. Principally, compensation coupling devices are connected between conductors to form multistage compensating regions.

In particular, in the first compensation stage of FIG. 2, a capacitor $C_{35}$ is connected between t3 (the tip line of pair 3) and t1 (the tip line of pair 1); capacitor $C_{46}$ is connected between r1 (the ring line of pair 1) and r3 (the ring line of pair 3); and capacitor $C_{25}$ is connected between r2 and r3. In the second compensation stage, capacitor $C_{34}$ is connected between t3 and r1; capacitor $C_{56}$ is connected between t1 and r3; capacitor $C_{14}$ is connected between t2 and r1; and capacitor $C_{37}$ is connected between t3 and t4. In the third stage, a capacitor $C_{48}$ is connected between r1 and r4; and a capacitor $C_{38}$ is connected between t3 and r4.

In FIG. 2, the near-end crosstalk (NEXT) on pairs 1&3 is assumed to be essentially balanced in the plug and the lead-frame due to symmetry. The first compensation stage of pairs 1&3 is implemented on the PWB by capacitors $C_{35}$ and $C_{46}$ where $C_{35}=C_{46}$. However, pairs 1&3 also experience a capacitance between its conductors 5 and 6 due to the series combination of $C_{25}$ and $C_{26}$, which had been added to form part of the compensation of pairs 1&2 and 2&3, respectively. If the resultant capacitance is $Cr_{56}$, then it can be derived from FIG. 2 that:

$$C_{r56}=(C_{25}\times C_{26})/(C_{25}+C_{26}). \quad \text{(Equation 1)}$$

Figure 3:
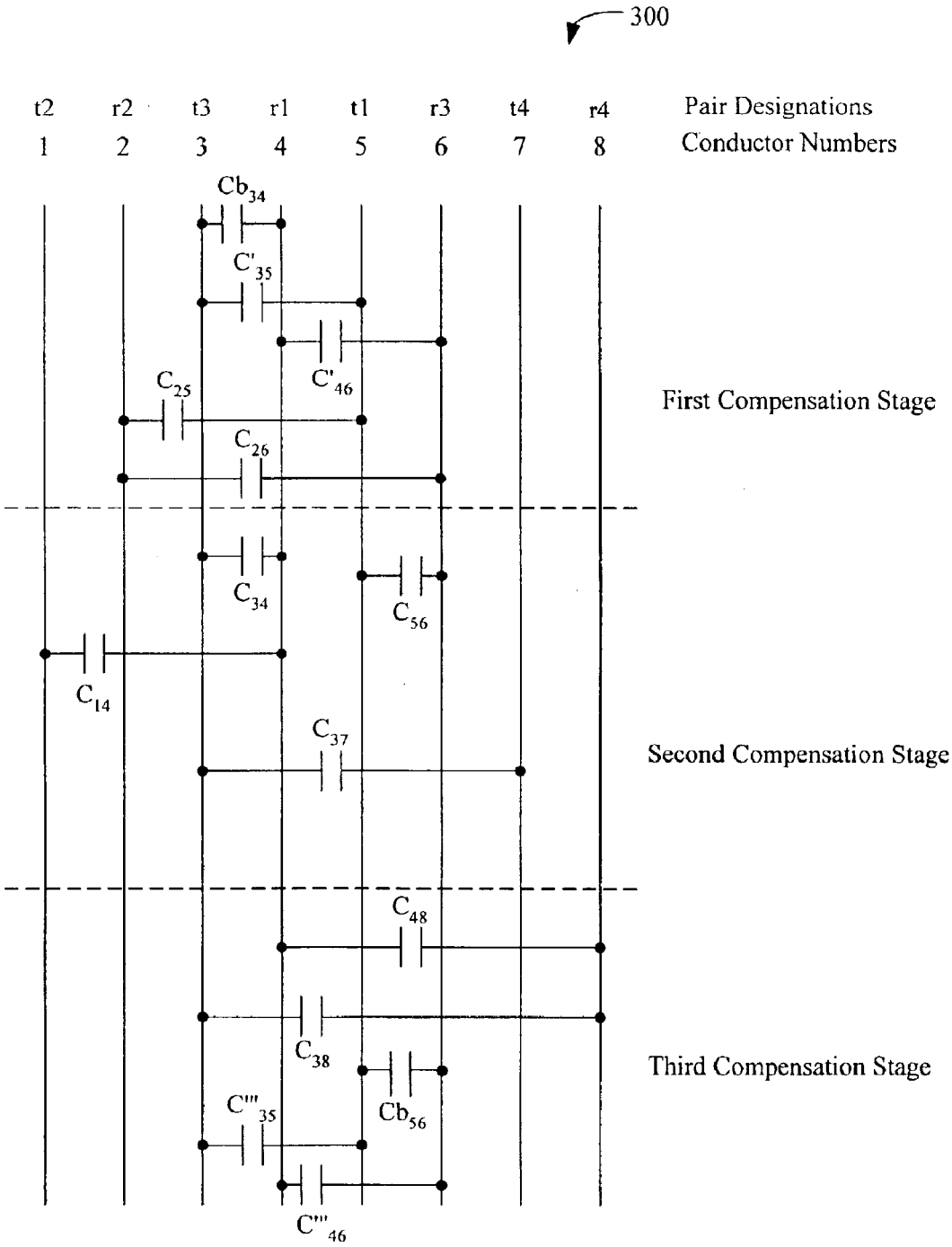
FIG. 3 is a schematic drawing representing an example embodiment of a system of the present invention for correcting crosstalk disturbances caused by a compensation scheme, such as the known compensation scheme of FIG. 2.

$C_{r56}$ is the capacitance between t1 and r3. It results in unbalancing the capacitive coupling of pair 1&3, since there is no capacitance to counter it between t3 and r1. To reestablish balance on pair 1&3, it has been determined in accordance with the present invention that a capacitor $C_{b34}$ having a value equal to $C_{r56}$ can be added between conductors 3 and 4 in the first stage, as shown in FIG. 3. Therefore:

$$C_{b34}=C_{r56}=(C_{25}\times C_{26})/(C_{25}+C_{26}) \quad \text{(Equation 2)}$$

However, the addition of $C_{b34}$ results in de-compensating pair 1 &3 of stage 1. This is corrected in accordance with the present invention by augmenting each of $C_{35}$ and $C_{46}$ by half of $C_{b34}$ so that:

$$C'_{35}=C_{35}+(C_{b34}/2) \quad \text{(Equation 3)}$$

$$C'_{46}=C_{46}+(C_{b34}/2). \quad \text{(Equation 4)}$$

This results in a first compensation stage having a balanced differential-mode to differential-mode crosstalk coupling on pair 1&3 that is equal in magnitude and polarity to the pre-correction unbalanced differential-mode to differential-mode compensation for the first compensation stage.

In examining the second compensation stage in FIG. 2, no capacitance appears between the conductors of pairs 1&3 from the capacitive couplings deployed between the conductors of the other pair combinations. Therefore, no correction is needed in the second compensation stage as long as:

$$C_{34}=C_{56}. \quad \text{(Equation 5)}$$

Therefore, in accordance with this example embodiment, the second compensation stage in FIG. 2 is the same as the second compensation stage in FIG. 3.

In the third compensation stage of FIG. 2, however, pairs 1&3 experience a capacitance between its conductors 3 and 4 due to the series combination of $C_{38}$ and $C_{48}$, which had been added to form part of the compensation of pairs 1&4 and 3&4 respectively. If the resultant capacitance is referred to as $C_{r34}$, then from FIG. 2 it can be shown that:

$$C_{r34}=(C_{38}\times C_{48})/(C_{38}+C_{48}). \quad \text{(Equation 6)}$$

Since $C_{r34}$ is the capacitance between t3 and r1, $C_{r34}$ results in unbalancing the capacitive coupling of pair 1&3 in the third compensation stage of FIG. 2. There is no capacitance to counter $C_{r34}$ between t1 and r3 in the third compensation stage of FIG. 2. To reestablish balance on pair 1&3, a capacitor $C_{b56}$ having a value equal to $C_{r34}$ is added between conductors 5 and 6 in the third compensation stage. Therefore:

$$C_{b56}=C_{r34}=(C_{38}\times C_{48})/(C_{38}+C_{48}). \quad \text{(Equation 7)}$$

However the addition of $C_{b56}$ results in de-compensating the third compensation stage of pair 1&3, which can be corrected by adding capacitors $C'''_{35}$ and $C'''_{46}$ each equal to half of $C_{b56}$ so that:

$$C'''_{35}=C'''_{46}=C_{b56}/2. \quad \text{(Equation 8)}$$

The overall corrected circuit 300 based on this solution is shown in FIG. 3.

Therefore, according to one embodiment of the present invention 300, compensating coupling devices are connected between conductors to compensate for the capacitive unbalance caused by compensation schemes: As shown by FIG. 3, the first compensation stage of FIG. 2 may be balanced by adding a capacitor $C_{b34}$ between t3 and r1, replacing capacitor $C_{35}$ with capacitor $C'_{35}$ between t3 and t1, and replacing capacitor $C_{46}$ with capacitor $C'_{46}$ between r1 and r3, where:

$$C_{b34}=C_{r56}=(C_{25}\times C_{26})/(C_{25}+C_{26}) \quad \text{(Equation 9)}$$

$$C'_{35}=C_{35}+(C_{b34}/2) \quad \text{(Equation 10)}$$

$$C'_{46}=C_{46}+(C_{b34}/2). \quad \text{(Equation 11)}$$

Further, the second compensation stage of FIG. 3 receives no correction as long as $C_{34}=C_{56}$. In the third compensation stage of FIG. 3, balance is achieved by adding capacitor $C'''_{35}$ between t3 and t1; by adding capacitor $C_{b56}$ between t1 and r3; and by adding capacitor $C'''_{46}$ between r1 and r3, where:

$$C_{b56}=(C_{38}\times C_{48})/(C_{38}+C_{48}) \quad \text{(Equation 12)}$$

$$C'''_{35}=C'''_{46}=C_{b56}=2. \quad \text{(Equation 13)}$$

Alternatively, the decompensation in the third stage of FIG. 3 can be corrected for in the second stage by reducing each of $C_{34}$ and $C_{56}$ by half of $C_{b56}$ such that:

$$C''_{34}=C_{34}-(C_{b56}/2); \text{ and} \quad \text{(Equation 14)}$$

$$C''_{56}=C_{56}-(C_{b56}/2). \quad \text{(Equation 15)}$$

Figure 4:
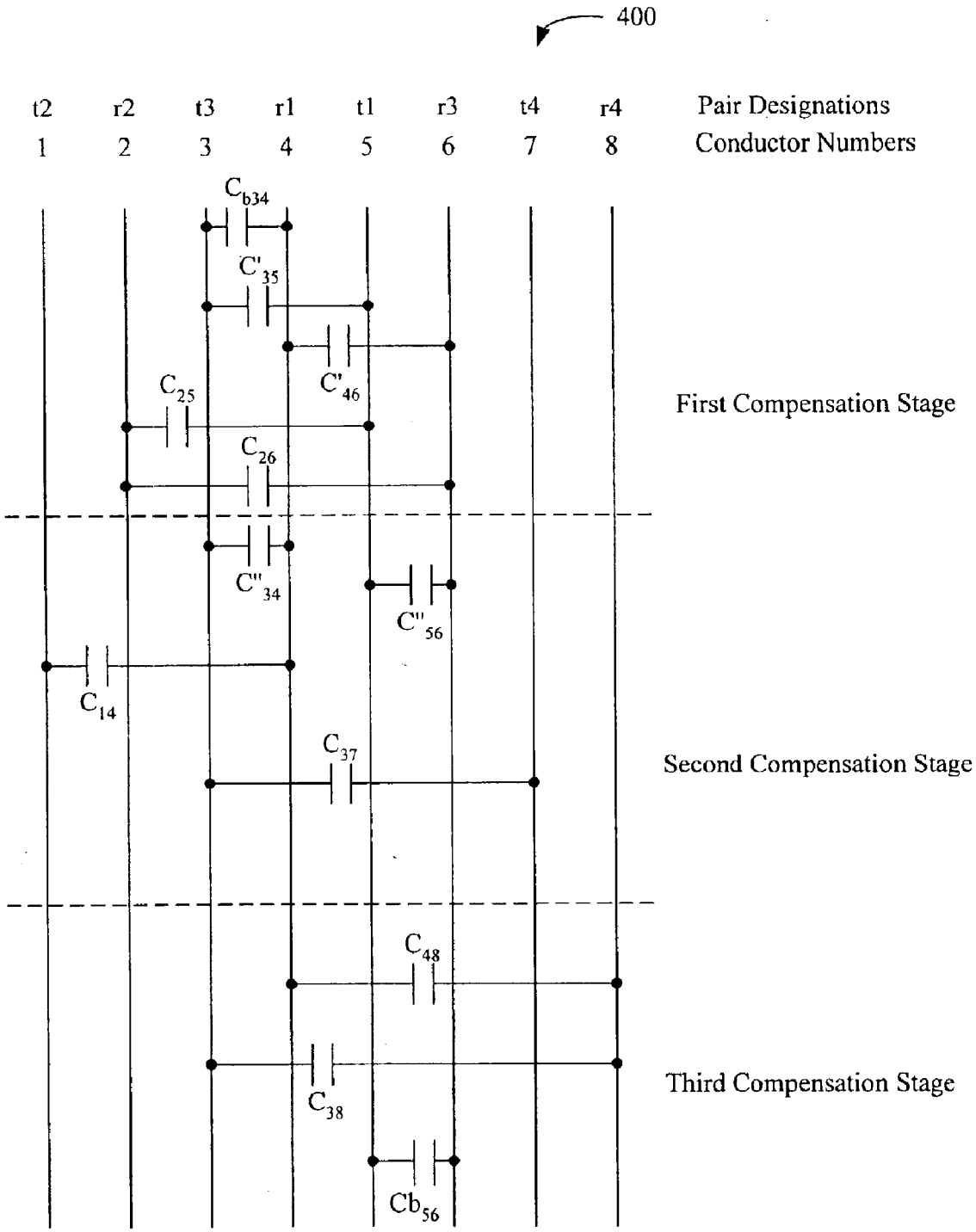
FIG. 4 is a schematic drawing representing another example embodiment of a system of the present invention for correcting crosstalk disturbances caused by a compensation scheme, such as the compensation scheme of FIG. 2.

The overall corrected circuit 400 based on this solution is shown in FIG. 4.

Therefore, according to a second example embodiment of the present invention 400, compensating coupling devices are connected between conductors to compensate for the capacitive unbalance caused by compensation schemes: As shown by FIG. 4, the first compensation stage of FIG. 2 may be balanced by adding capacitor $C_{b34}$ between t3 and r1, replacing capacitor $C_{35}$ with capacitor $C'_{35}$ between t3 and t1, and replacing $C_{46}$ with capacitor $C'_{46}$ between r1 and r3, where:

$$C_{b34}=(C_{25}\times C_{26})/(C_{25}+C_{26}) \quad \text{(Equation 16)}$$

$$C'_{35}=C_{35}+(C_{b34}/2) \quad \text{(Equation 17)}$$

$$C'_{46}=C_{46}+(C_{b34}/2). \quad \text{(Equation 18)}$$

Correspondingly, in the second compensation stage, capacitor $C_{34}$ is replaced with capacitor $C''_{34}$ between t3 and r1, and capacitor $C_{56}$ is replaced with capacitor $C''_{56}$ between t1 and r3; and in the third compensation stage, $C_{b56}$ is added between t1 and r3, where:

$$C_{b56}=(C_{38}\times C_{48})/(C_{38}+C_{48}) \quad \text{(Equation 19)}$$

$$C''_{34}=C_{34}-(C_{b56}/2) \quad \text{(Equation 20)}$$

$$C''_{56}=C_{56}-(C_{b56}/2). \quad \text{(Equation 21)}$$

Figure 5:
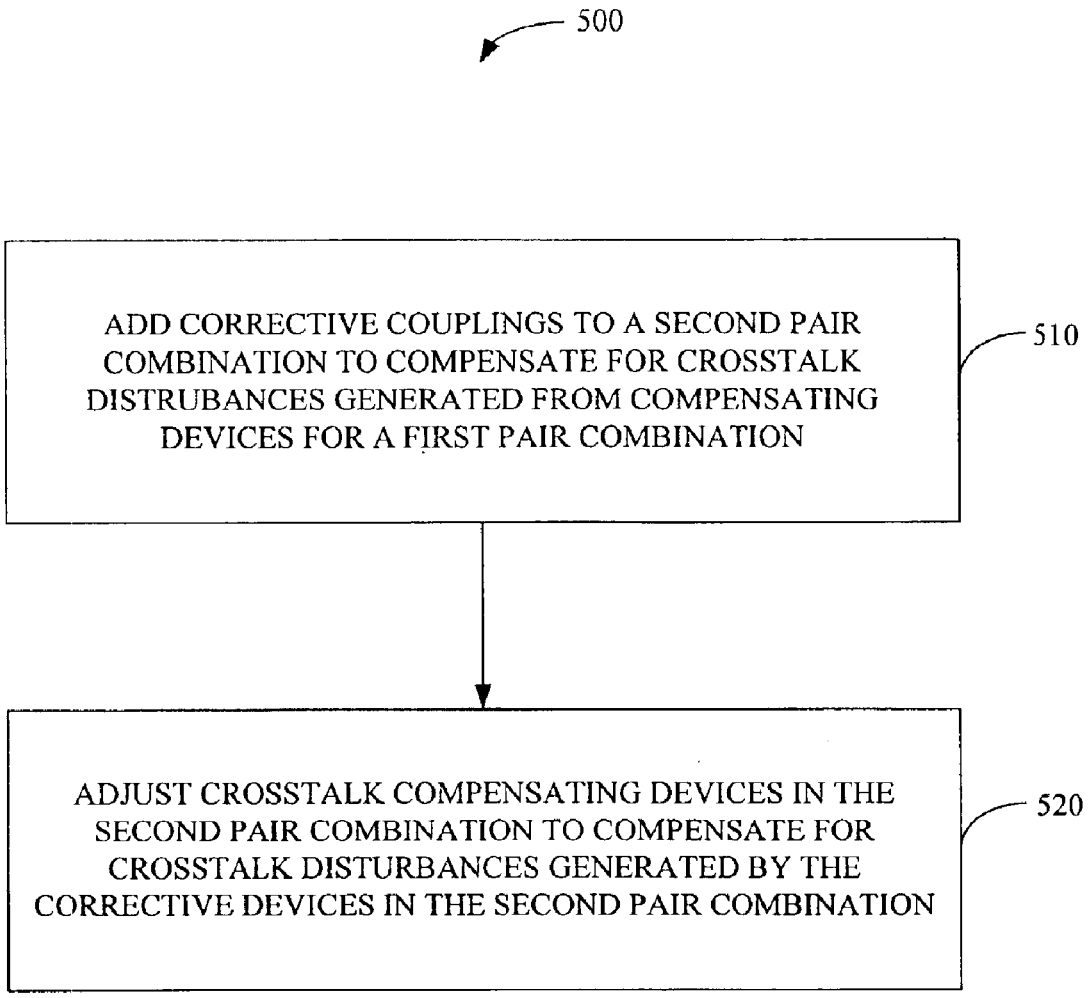
FIG. 5 is a flowchart describing an embodiment of a method of the present invention for correcting crosstalk disturbances caused by a compensation scheme, such as the compensation scheme of FIG. 2.

As shown in FIG. 5, the present invention also provides a method 500 for balancing crosstalk in a connector, wherein a compensation scheme in a first pair combination disturbs the crosstalk balance of a second pair combination. In block 510, corrective capacitive devices are added to the second pair combination to compensate for the crosstalk unbalance in the second pair combination. Method 500 also includes the step of adjusting the compensating coupling devices in the second pair combination to compensate for crosstalk disturbances caused from the corrective coupling devices in the second pair combination, as depicted in block 520.

Although the example above deals with pairs 1&3, the invention can be applied to any pair combination which has its crosstalk balance disturbed due to interactions from compensation schemes on other pair combinations. It also should be understood that the present invention can be implemented using any type of coupling device (e.g. either capacitors or mutual inductors or both). Furthermore, these devices may be discrete or integral parts of printed wiring boards, lead-frames, or stamped metal conductors, for example.

One of the advantages of the present invention is the lowering of NEXT in communication connecting hardware, which is important for complying with the proposed Category 6 cabling standard by the Telecommunication Industry Association. To meet the Category 6 standard, a connector will have to satisfy NEXT requirements from 1 MHz to 250 MHz, whereas poor NEXT performance can cause connectors to degrade by as much as a whole category.

It should be emphasized that the above-described embodiments of the present invention are merely possible examples of implementations, merely set forth for a clear understanding of the principles of the invention. Many variations and modifications may be made to the above-described embodiments of the invention without departing substantially from the principles of the invention. For example, the invention can be applied to any conductor pair combination to balance crosstalk from a plurality of stages in a compensation scheme, using any type of capacitive coupling device, beyond the examples stated in this description. All such modifications and variations are within the scope of this disclosure and the present invention.

What is claimed:

1. A system for balancing crosstalk in an electrical connector, the connector having three or more pairs of conductors, wherein two pairs of conductors form a pair combination, at least two compensating coupling devices being connected between conductor pairs of a first pair combination, the at least two compensating coupling devices disturbing the crosstalk balance of a second pair combination, the system comprising:

at least one corrective coupling device connected between the conductor pairs of the second pair combination, wherein the corrective coupling device compensates for the crosstalk unbalance in the second pair combination generated from the compensating coupling device in the first pair combination.

2. The system of claim 1, wherein the second pair combination has at least one compensating coupling device, and wherein the compensating coupling device in the second pair combination is adjusted to compensate for the crosstalk disturbances caused by the corrective coupling device in the second pair combination.

3. The system of claim 1, wherein the corrective coupling device comprises a capacitor.

4. The system of claim 1, wherein the corrective coupling device comprises a mutual inductor.

5. The system of claim 1, wherein the corrective coupling device comprises integral parts of printed wire boards.

6. The system of claim 1, wherein the corrective coupling device comprises integral parts of lead frames.

7. The system of claim 5, wherein the printed wiring board includes at least two layers of wiring paths.

8. The system of claim 1, wherein the connector is comprised by a plug.

9. The system of claim 1, wherein the connector is comprised by a jack.

10. A system for balancing crosstalk in an electrical connector, the connector having three or more pairs of conductors, wherein two pairs of conductors form a pair combination, at least two compensating coupling devices being connected between the conductor pairs of a first pair combination, the at least two compensating coupling devices disturbing the crosstalk balance of a second pair combination, the system comprising:

means for correcting crosstalk disturbance generated by the first pair combination in the second pair combination.

11. The system of claim 10, wherein the means for correcting comprises:

at least one corrective coupling device disposed between the conductor pairs of the second pair combination, wherein the corrective coupling device compensates for crosstalk unbalance generated by the compensating coupling device in the first pair combination.

12. The system of claim 11, wherein the second pair combination has at least one compensating coupling device, and wherein the means for correcting further comprises means for adjusting the compensating coupling device in the second pair combination to compensate for crosstalk disturbance caused by the corrective coupling device in the second pair combination.

13. A method for balancing crosstalk in a connector, the connector having three or more pairs of conductors, wherein two pairs of conductors form a pair combination, and wherein at least two compensating coupling devices are connected between a first pair combination, the at least two compensating coupling devices disturbing the crosstalk balance of a second pair combination, the method comprising the step of:

correcting crosstalk disturbance generated by the first pair combination in the second pair combination.

14. The method of claim 13, wherein the correcting step comprises adding at least one corrective coupling device between the second pair combination, wherein the corrective coupling device compensates for crosstalk unbalance generated by the compensating coupling device in the first pair combination.

15. The method of claim 14, wherein the second pair combination has at least one compensating coupling device, and wherein the correcting step further comprises:

adjusting the compensating coupling device in the second pair combination to compensate for crosstalk disturbance caused by the corrective coupling device in the second pair combination.

16. The method of claim 13, wherein the corrective coupling device comprises integral parts of lead frames.

17. The method of claim 13, wherein the corrective coupling device comprises a capacitor.

18. The method of claim 13, wherein the corrective coupling device comprises a mutual inductor.

19. The system of claim 1, wherein the corrective coupling device comprises integral parts of printed wire boards.

20. A system for balancing crosstalk in an electrical connector, the connector having three or more pairs of conductors, wherein two pairs of conductors form a pair combination, a first compensating coupling device being connected between conductor pairs of a first pair combination and a second compensating coupling device connected between conductor pairs of a second pair combination, the first and second compensating coupling devices disturbing the crosstalk balance of a third pair combination, the system comprising:

at least one corrective coupling device connected between conductor pairs of the third pair combination, wherein the corrective coupling device compensates for the crosstalk unbalance in the third pair combination generated from the compensating coupling devices in the first and second pair combinations.

21. The system of claim 20, wherein the third pair combination has at least one compensating coupling device, and wherein the compensating coupling device in the third pair combination is adjusted to compensate for the crosstalk disturbances caused by the corrective coupling device in the third pair combination.

22. The system of claim 20, wherein the corrective coupling device comprises a capacitor.

23. The system of claim 20, wherein the corrective coupling device comprises a mutual inductor.

24. The system of claim 20, wherein the corrective coupling device comprises integral parts of printed wire boards.

25. The system of claim 20, wherein the corrective coupling device comprises integral parts of lead frames.

26. The system of claim 24, wherein the printed wiring board includes at least two layers of wiring paths.

27. The system of claim 20, wherein the connector is comprised by a plug.

28. The system of claim 20, wherein the connector is comprised by a jack.

29. A method for balancing crosstalk in a connector, the connector having three or more pairs of conductors, wherein two pairs of conductors form a pair combination, and wherein a first compensating coupling device is connected between conductor pairs of a first pair combination and a second compensating coupling device connected between conductor pairs of a second pair combination, the first and second compensating coupling devices disturbing the crosstalk balance of a third pair combination, the method comprising the step of:

correcting crosstalk disturbance generated by the first and second pair combinations in the third pair combination.

30. The method of claim 29, wherein the correcting step comprises adding at least one corrective coupling device between conductors of the third pair combination, wherein the corrective coupling device compensates for crosstalk unbalance generated by the compensating coupling device in the first and second pair combinations.

31. The method of claim 30, wherein the third pair combination has at least one compensating coupling device, and wherein the correcting step further comprises:

adjusting the compensating coupling device in the third pair combination to compensate for crosstalk disturbance caused by the corrective coupling device in the third pair combination.

32. The method of claim 29, wherein the corrective coupling device comprises integral parts of lead frames.

33. The method of claim 29, wherein the corrective coupling device comprises a capacitor.

34. The method of claim 29, wherein the corrective coupling device comprises a mutual inductor.

* * * * *